US007507046B2

(12) United States Patent
Ehmann

(10) Patent No.: US 7,507,046 B2
(45) Date of Patent: Mar. 24, 2009

(54) BORDERLESS PLATEN DRIVE PRINTING

(75) Inventor: Michael J. Ehmann, Geneseo, NY (US)

(73) Assignee: Eastman Kodak Company, Rochester, NY (US)

( * ) Notice: Subject to any disclaimer, the term of this patent is extended or adjusted under 35 U.S.C. 154(b) by 39 days.

(21) Appl. No.: 11/091,155

(22) Filed: Mar. 28, 2005

(65) Prior Publication Data

US 2006/0216095 A1 Sep. 28, 2006

(51) Int. Cl.
*B41J 11/00* (2006.01)

(52) U.S. Cl. ..... 400/649; 400/648; 271/175; 347/176; 347/198; 347/215; 347/218; 347/220

(58) Field of Classification Search ..... None
See application file for complete search history.

(56) References Cited

U.S. PATENT DOCUMENTS 4,617,577 A * 10/1986 Takahashi et al. ..... 347/197
5,117,241 A * 5/1992 Stephenson ..... 347/214
5,124,724 A * 6/1992 Hatakeyama et al. ..... 347/172
5,196,863 A 3/1993 Palmer et al.
5,441,353 A 8/1995 Kim
5,469,204 A 11/1995 Kim et al.
5,497,182 A 3/1996 Park et al.
5,499,880 A 3/1996 Pickering et al.
5,647,679 A * 7/1997 Green et al. ..... 400/232
6,392,681 B1 * 5/2002 Wood et al. ..... 347/218
6,400,386 B1 * 6/2002 No ..... 347/176
2004/0207707 A1 * 10/2004 Ohashi et al. ..... 347/104

* cited by examiner

*Primary Examiner*—Jill E. Culler
(74) *Attorney, Agent, or Firm*—David A. Novais; Roland R. Schindler, II

(57) ABSTRACT

A printer has a path for a sheet. A donor web is disposed on one side of the path; a platen roller is disposed on the other side of the path and supports the sheet during printing. An edge sensor is located in path at a known distance from the nip of the print head and the platen. Edge sensor senses the lead edge of the sheet and then the control circuit drives the lead edge to a distance D from the heat line of the print head. The head lowers, is selectively energized and the platen moves to carry the donor web and sheet past the head and provide a borderless printed image on the sheet.

6 Claims, 8 Drawing Sheets

BORDERLESS PLATEN DRIVE PRINTING

FIELD OF THE INVENTION

This invention relates in general to methods of printing and printers and in particular to methods of borderless printing and printers for providing borderless prints.

BACKGROUND OF THE INVENTION

Many photographers use digital cameras to capture images. Unlike conventional wet processing of silver halide film and papers, digital images can be printed directly onto sheets of paper. Color images may be printed using ink jet printers, multicolor transferable toner printers, heat sensitive coated paper printers, or thermal dye transfer printers. Many mass-market retail establishments have user-friendly kiosks where shoppers may make color prints. A large number of these kiosks use thermal dye transfer printers. Because the kiosks use large amounts of paper, the images may be printed on a continuous web of paper. The images are later separated from each other and from the web by a suitable cutter or knife. Such prints have dye images that bleed to the edges in the latitudinal and longitudinal directions. These prints are known as borderless prints and are the most popular prints with consumers.

Thermal dye transfer printers generate very high quality images. As such, a number of photographers want their own thermal dye transfer printer. However, it is impractical and not cost effective to supply continuous web paper for the images. It would also be expensive to supply built-in paper cutters and knives to provide borderless prints. To meet the demand for borderless prints, there are known methods of bleeding the latitudinal edges so that there is no border on the tops and bottoms of prints. See, for example, U.S. Pat. Nos. 5,441,353; 5,196,863; and 5,499,880. However, those techniques cannot provide prints that bleed to the longitudinal borders.

To solve this problem and provide full borderless prints, others use special manufactured sheets of paper that carry perforated longitudinal leading and trailing borders. The leading edge and the trailing edge of the paper are perforated to let the user remove them from the finished print. In this way, the printed image may slightly exceed the area between the perforations. The excess portion of the image is removed with the perforated leading and trailing edge to provide the user with a borderless image.

A key drawback of the existing solution is the requirement for special paper with perforations on the leading and trailing edges. Such paper is expensive to manufacture and has little or no other market outside of printing digital images. In addition customers are dissatisfied with the requirement for tearing off the perforated edges of the printed images. However, conventional printers are not configured to use ordinary paper and provide borderless prints.

In a conventional thermal printer, paper is clamped between a capstan roller and a pinch roller and pulled through a nip between a thermal print head and the platen. The capstan and pinch rollers are driven by a stepper motor that provides both precise movement and control of the paper sheet. The print head and platen capture a web of donor material with dye and press it against the paper. The platen spins freely while the web and receiver are pulled past the print head. Heat from the thermal head transfers dye from the donor web onto the receiver paper to create an image.

An example of a prior art thermal dye transfer printer 600 that provides monotone, multi-tone or full color printing is shown in FIG. 6. A printer 600 has a sheet 8 that is driven along a print path 4 by a set of tension rollers 30, 31. The print head 25 is opposite a free spinning platen 33. Donor and supply rollers 20, 22 support a web 21 of thermal dye donor material. A bias spring 36 presses the print head 25 against the donor web 21 that contacts the receiver paper. A pinch spring 35 urges pinch roller 30 against capstan roller 31 that is turned by a stepper motor 34. A transmission, such as a belt 32, connects the capstan roller 31 to stepper motor 34. The leading edge of sheet 8 is fed into a pinch or nip between rollers 30, 31. They pull the sheet and the web past print head 25 where donor material is transferred to the sheet 8. The printer 600 uses paper with a perforated leading and trailing edges. Dye is transferred to the receiver paper and slightly beyond the perforations. When the perforated edges are removed, the longitudinal ends the print are without any border, and the print appears to bleed to the ends of the sheet.

SUMMARY OF THE INVENTION

The invention provides both a method and apparatus for borderless printing. In the apparatus, the invention provides a print head that is moveable toward and away from a donor web. The donor web is disposed between supply and take-up reels. The print head is on one side of the donor web; on the other side is a cylindrical platen. The sheet of paper is fed by urge rollers toward a nip between the print head and the platen. The paper travels along a path from a supply bin to an exit bin. A sensor is located in the path of the paper for detecting the edge of the paper as it approaches and leaves the print head. The sensor may also align the lead edge of the paper. Upon detecting the lead edge of the paper, the apparatus then drives the lead edge along a path to a location that will dispose the lead edge in the nip of the print head and the platen when the print head is lowered. The sensor provides the information for the stepper motor to precisely position the lead edge of the paper in a predetermined position for borderless printing. That position places the lead edge proximate to and just short of the corresponding position of the linear array of thermal printing elements disposed in the print head. Then the print head and/or platen move relative to each other in order to clamp the lead edge of the paper between the print head and the platen. The platen is then driven and the print head is energized in order to provide a full bleed print from the leading edge to trailing edge. The sensor senses the trailing edge of the sheet. The sheet is driven to carry its trailing edge past the linear array of printing elements and then the sheet is returned to its initial position for printing the next color. Thus, the invention may provide single, dual or full-color prints.

DETAILED DESCRIPTION OF THE INVENTION

Figure 1:
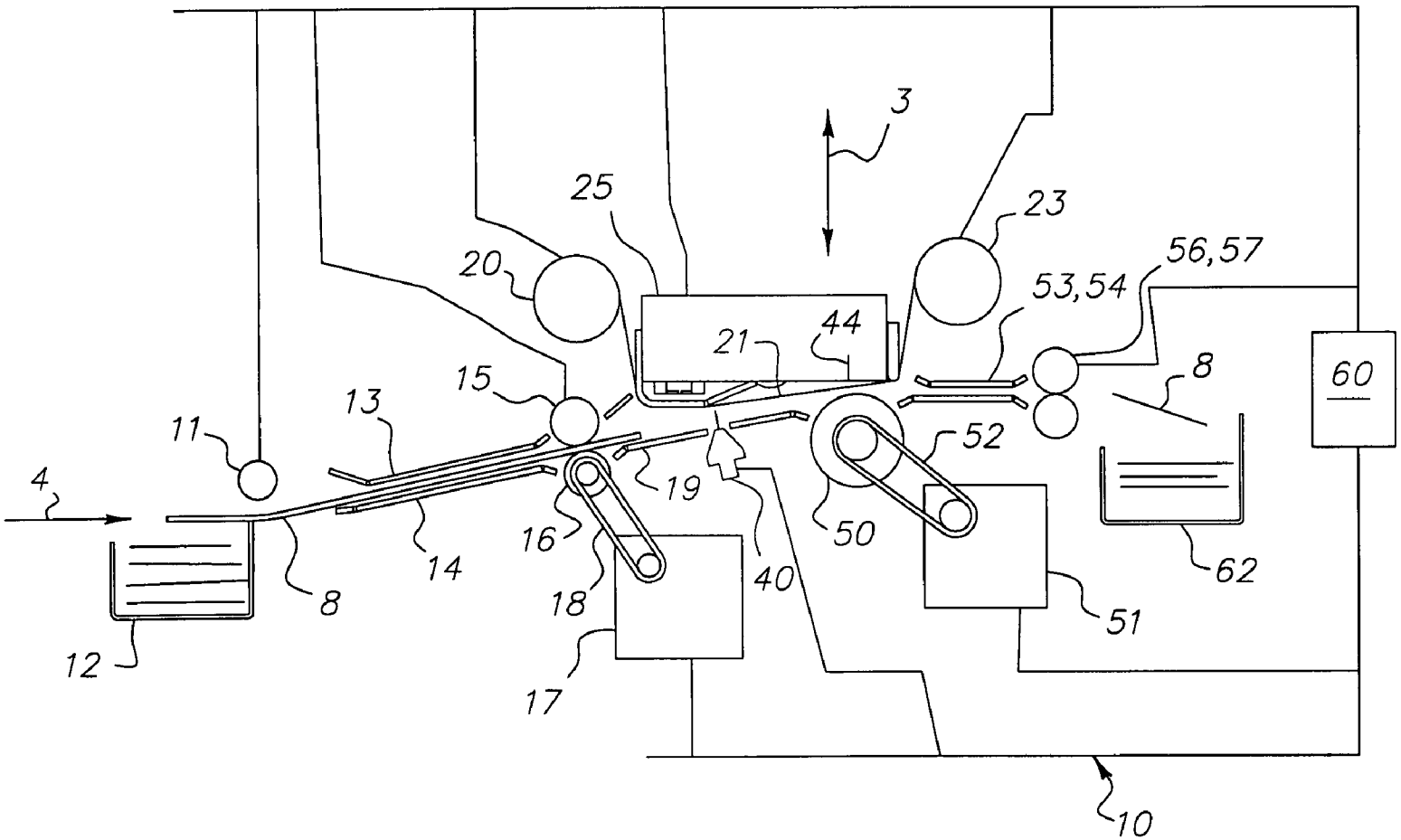
FIG. 1 is a mechanical schematic view of the printing apparatus.

Referring now to FIGS. 1-4, there is shown a borderless thermal dye thermal printing assembly 10 for printing images along the width and length of sheet 8, such as a sheet of paper. Printer 10 has a thermal print head 25 that has a linear array of heating elements 44 commonly known as a heat line or print line. The terms "linear array of heating elements", "heat line" and "print line" are used interchangeably in this patent. A donor supply roller 20 on one side of the thermal print head 25 provides donor web 21 having thermal donor material such as dyes, colorants, or protective coating material. Donor web 21 travels across the linear array of heat elements (heat line) 44 and is wound on a donor take-up reel 23. Donor web 21 can comprise a single color of donor material for monotone printing, but it preferably comprises at least three sequential sections of differently colored donor material in order to provide full-color print and a clear section for applying a protective cover on the print. Beneath print head 25 is a cylindrical platen 50. Platen 50 is coupled to a platen stepper motor 51 by a suitable transmission 52 such as a belt. Those skilled in the art understand that FIGS. 1-4 are schematic in nature and other suitable means are possible for connecting the platen stepper motor 51 to the cylindrical platen 52 in order to turn cylindrical platen 50. Such other means includes and are not limited to gear trains. Thermal print head 25 is coupled to control circuit 60. Control circuit 60 is coupled to a further motor (not shown) that controls the vertical position of the thermal print head 25. In operation, control circuit 60 operates the motor (not shown) or solenoid in order to move thermal print head 25 in the direction shown by the arrow 3. Sheet 8 or other image receiving sheets are stored in a hopper 12. Top sheet 8 from hopper 12 is removed from hopper 12 by a suitable pick roller 11. Sheet 8 travels along a printing path 4 that leads it between surface guides 13, 14, urge rollers 15, 16, print head guide 19, platen 50, exit guides 53, 54 and exit urge rollers 56, 57, into exit hopper 62. A control circuit 60 is connected to the moveable and operative elements of the printer for controlling their individual and coordinated operation. Those skilled in the art understand that control circuit 60 is a schematic representation for a hard-wired controller or a processor controlled system that uses a combination of software and hardware to control and operate printer 10 and its components.

The entrance urge rollers 15, 16 are disposed at one end of the paper guides 13, 14. Entrance urge 15, 16 rollers are biased together by a suitable spring or other biasing structure, not shown, so that rotary motion imported to one roller is transmitted to the other. Roller 15 is a pinch roller and roller 16 is driven by stepper motor 17 and transmission 18. Transmission 18 is shown as a belt but may be any suitable transmission known in the art that can be used to connect the rotary motion of motor 17 to roller 16. Sheet 8 exits the nip of urge rollers 15, 16 and is supported by thermal head guide 19. The body of thermal head guide 19 has an edge sensor 40. Edge sensor 40 is any suitable sensor for identifying the leading edge 8.1 or trailing edge 8.2 of sheet 8. Edge sensor 40 may be optical, mechanical, or a combination optical/mechanical device that senses the leading and trailing edges of the sheet. Edge sensors 40 are well-known in printers and photocopiers and any suitable, conventional edge sensor 40 may be used. In addition, edge sensor 40 may be combined with a suitable gate (not shown).

Edge sensor 40 is disposed so that it can detect lead edge of sheet 8 when sheet 8 is at a known distance from the array of heat elements (heat line) 44. Distance D is the offset of a leading edge 8.1 of sheet 8 from the heat line 44 when sheet 8 is in its initial position. Edge sensor 40 is also coupled to control circuit 60. In response to edge sensor 40 detecting leading edge 8.1 of sheet 8, control circuit 60 drives urge stepper motor 17 a predetermined number of steps in order to move sheet 8 toward heat line 44 and to stop sheet 8 with its lead edge 8.1 at a distance D from heat line 44. The initial position is a distance D just short of heat line 44 and is close enough to heat line 44 that lead edge 8.1 of sheet 8 will be captured in the nip between web 21 and platen 50.

Figure 3B:
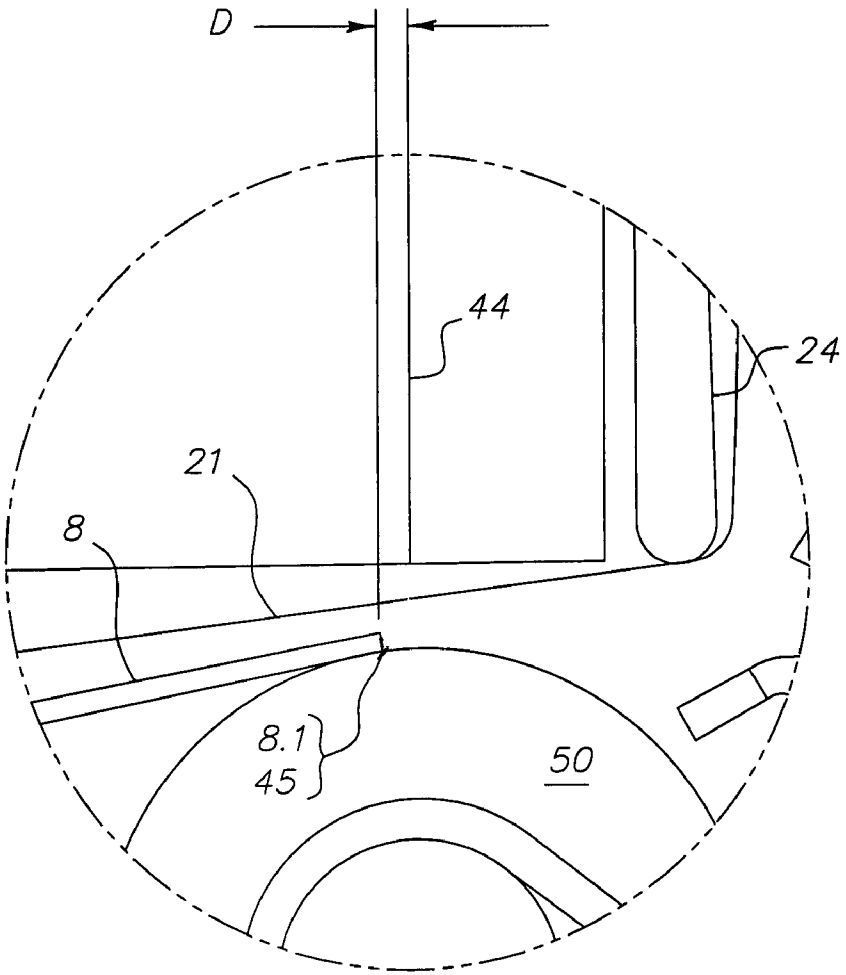
FIGS. 3A and 3B are, respectively, views of the next step where the sheet is driven to an initial position proximate the heat/print line or the print head including an enlarged partial view of the initial position.

Urge rollers 15, 16 drive sheet 8 to the initial position that is shown in more detail in FIG. 3B. After sheet 8 is in the initial position, control circuit 60 drives print head 25 downward in the direction of arrow 3 in order to clamp sheet 8 between print head 25 and platen 50. With sheet 8 in place, platen stepper motor 51 and thermal print head 25 and its linear array (heat line) 44 are energized so that sheet 8 and donor web 21 are clamped together and driven past linear array 44. A peel plate 24 sharply alters the direction of donor web 21. Peel plate 24 separates web 21 from sheet 8 that continues to travel between exit guides 53, 54 and into the nip of exit and urge rollers 56, 57. Exit urge rollers 56, 57 are likewise under control of control circuit 60. Exit urge rollers 56, 57 are operable to rewind and feed sheet 8 back toward urge rollers 15, 16. Sheet 8 is rewound and fed back during multicolor printing. After multicolor printing is completed, exit urge rollers 56, 57 discharge sheet 8 into discharge bin 62.

Figure 2A:
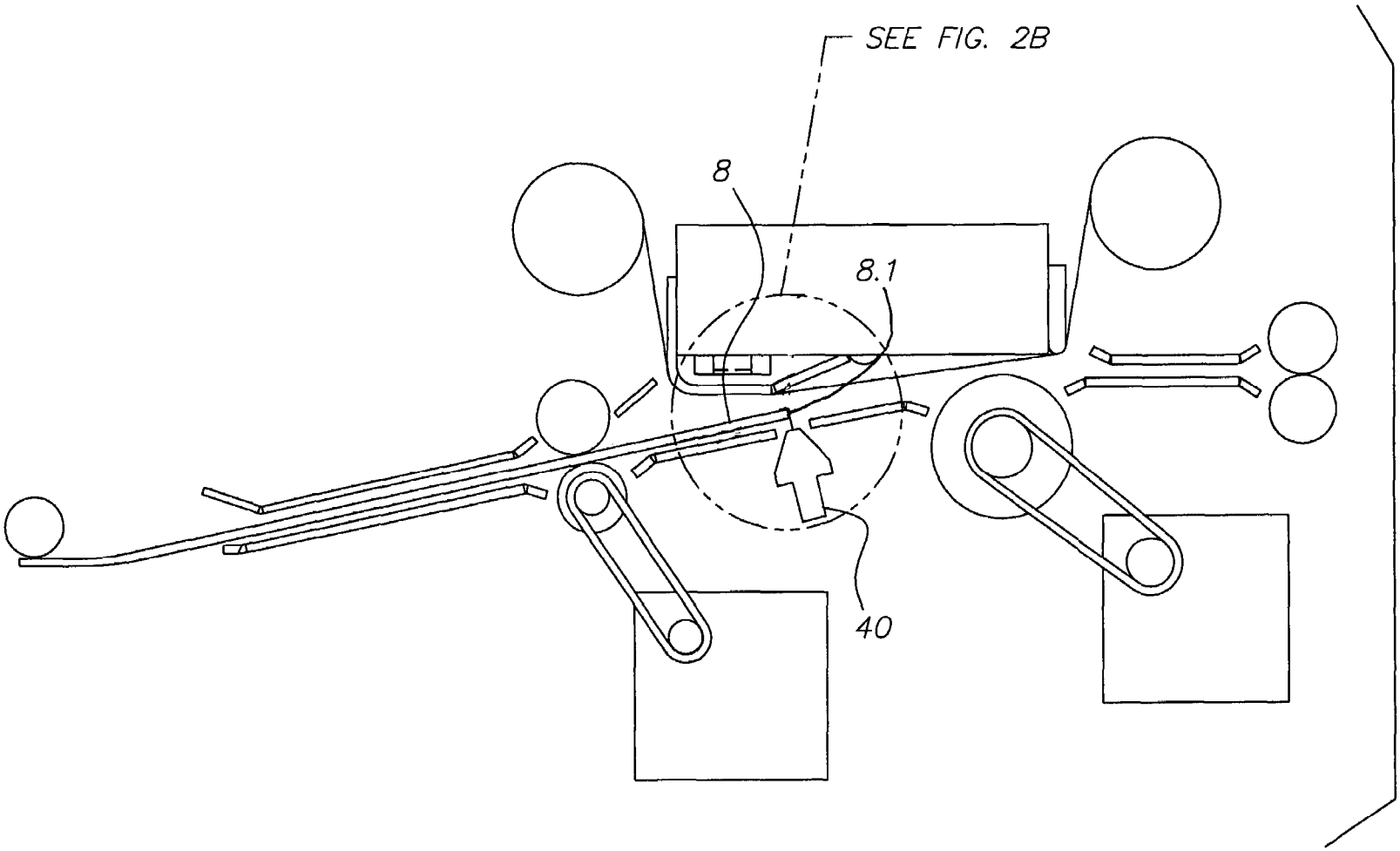
FIGS. 2A, 2B are, respectively, schematic views of the apparatus with the sheet aligned to a sensor and an enlarged partial view of the sheet and the sensor.
Figure 2B:
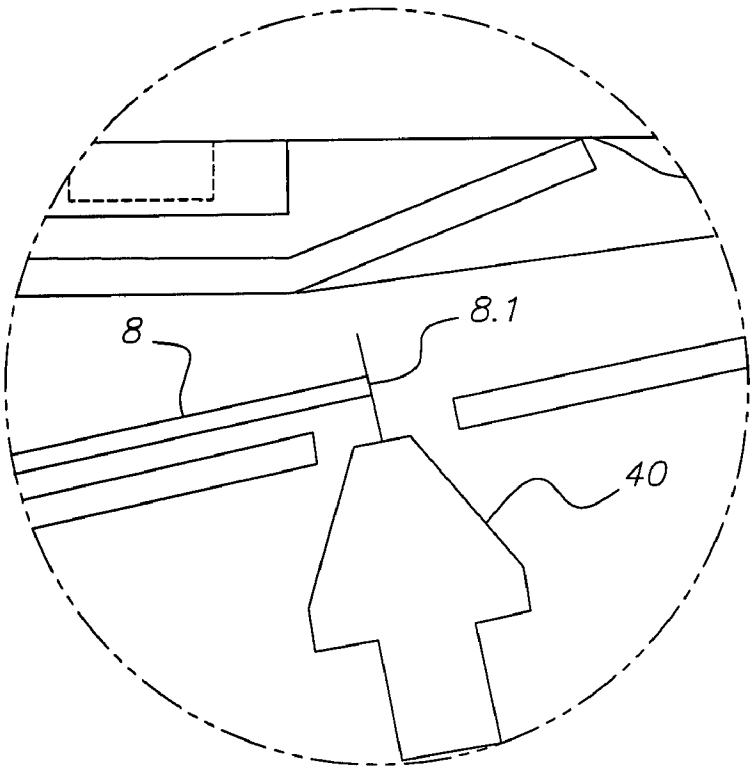

Turning now to FIGS. 2A, 2B and 3A, 3B, there are shown details of the operation of edge sensor 40 and the clamping operation. In FIGS. 2A and 2B, sheet 8 is shown at edge sensor 40. Those skilled in the art understand that sheet 8 has its lateral sides aligned and deskewed so that the leading edge of sheet 8 is transverse to path 4 of travel and is substantially aligned parallel to the linear array 44. Edge sensor 40 thus senses the position of the leading edge at the location of edge sensor 40. This location is a predetermined distance D from the heat line or linear array 44. In FIG. 3B where the lead edge of sheet 8 is shown at location D that is approximately 0.020 inches (0.0508 cm) from the heat line linear array 44.

However, in other embodiments, sheet 8 is precisely positioned and repositioned by one or more of the stepper motors that operate the pairs of urge rollers 15, 16 and exit urge rollers 56, 57 and the platen 50. In a preferred embodiment, only platen 50, urge rollers 15, 16 or exit urge rollers 56, 57 moves sheet 8 at any one time. Thus, in this embodiment, urge rollers 15, 16 control movement of sheet 8 past edge sensor 40 to heat line 44. Platen 50 controls movement of sheet 8 beneath heat line 44. Exit urge rollers 56, 57 control return of sheet 8 toward its initial position and its final discharge from printer 10. The exit urge rollers 56, 57 release control of sheet 8 at a predetermined distance after a trailing edge 8.2 (see FIG. 5) of sheet 8 passes edge sensor 40. Then rollers 15, 16 resume control to precisely reposition sheet 8 at the initial position that is within the distance D of print line 44.

Control circuit 60 operates urge rollers 15, 16 to move leading edge 8.1 of sheet 8 beyond print head guide 19 and into the space between print head 25 and platen 50. Urge rollers 15, 16 may be permanently engaged or may be selectively engaged. To selectively engage urge rollers 15, 16, an upper urge roller 15 may be spring biased away from a driver urge roller 16 and an actuator (not shown) controlled by control circuit 60 is operable to move urge roller 15 into or out of engagement with urge roller 16. Exit urge rollers 56, 57 may be similarly constructed. If urge rollers 15, 16 and exit urge rollers 56, 57 are permanently engaged, then they will be actuated as described above.

Figure 3A:
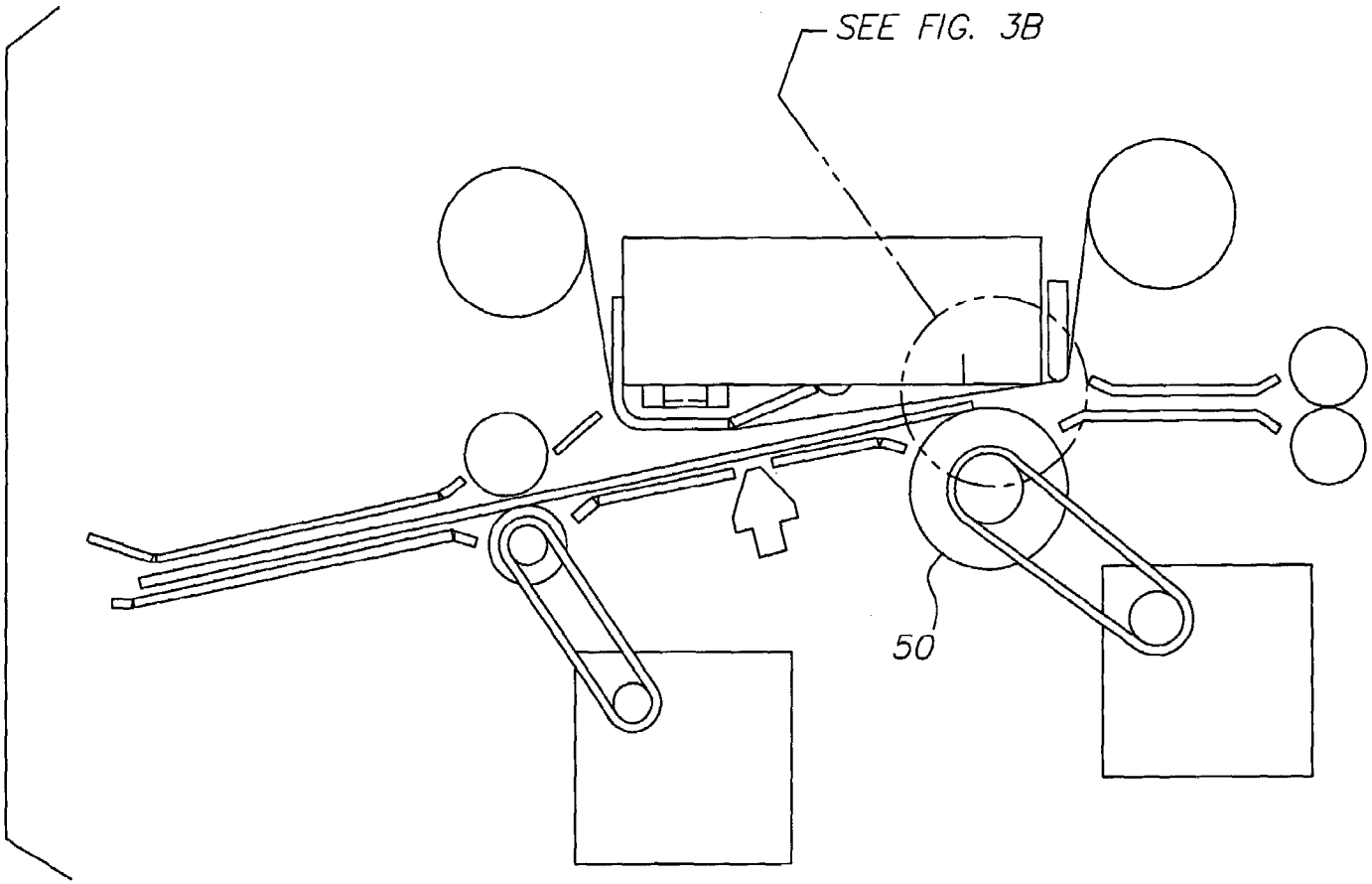
Figure 4A:
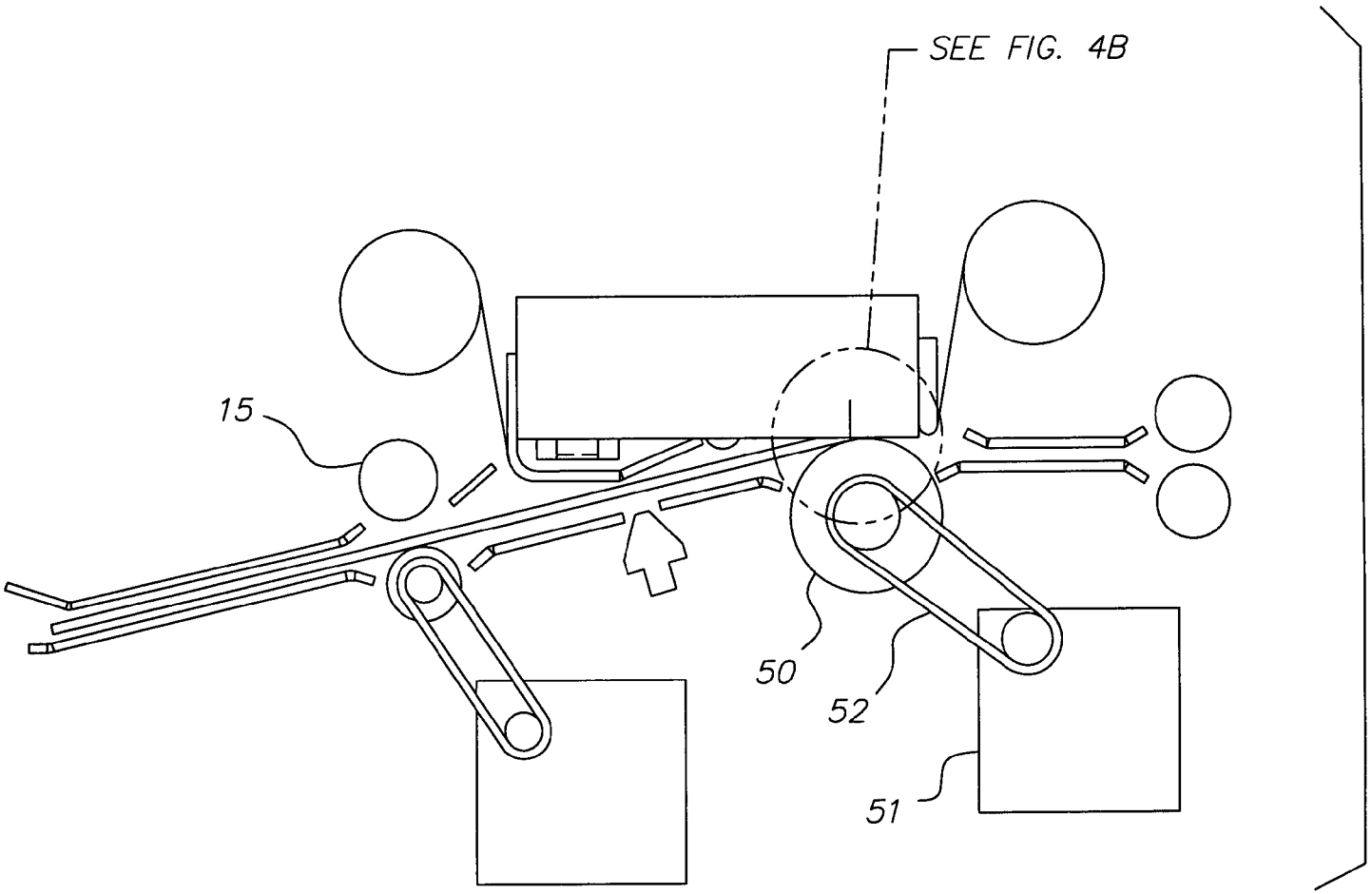
FIGS. 4A, 4B are views of the next step where the print head has moved vertically to clamp the sheet between the donor web and the platen with FIG. 4B showing a detail of that clamping operation.
Figure 4B:
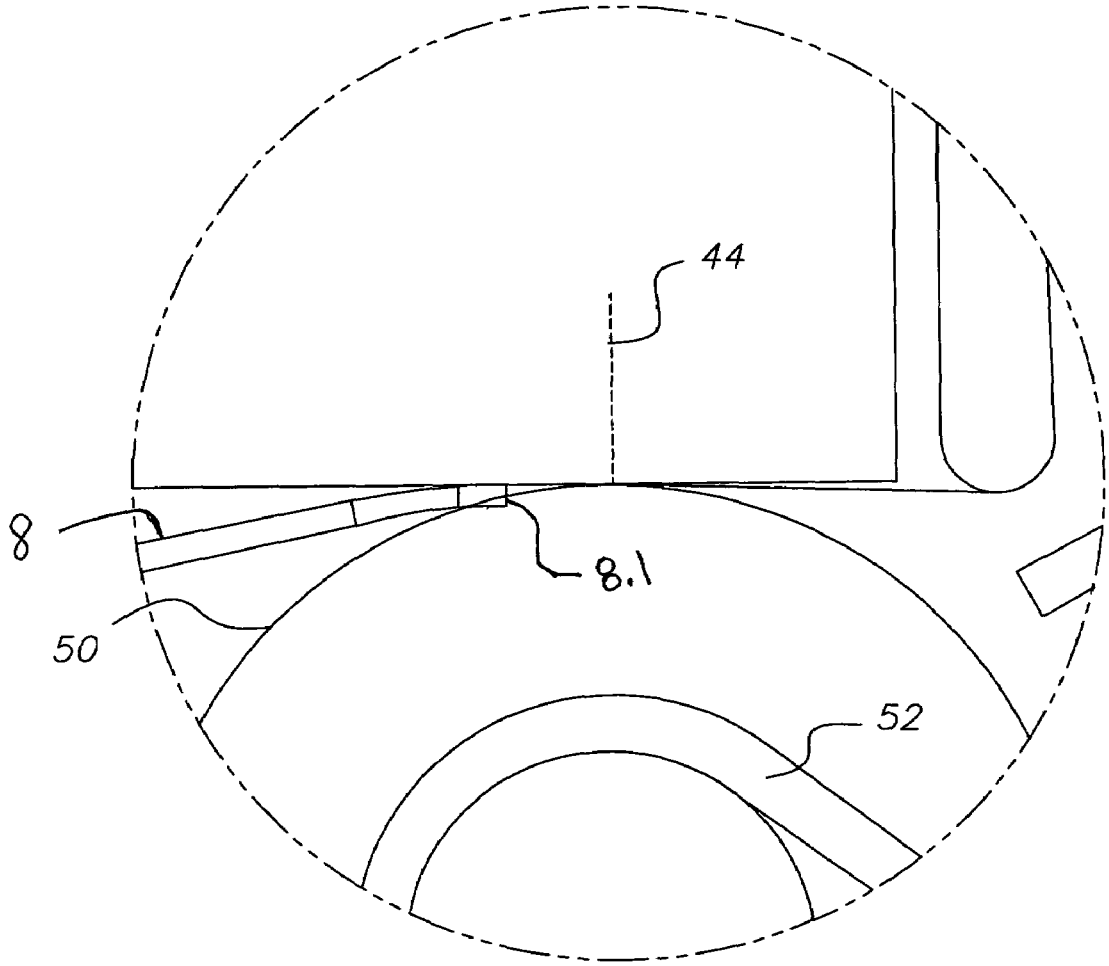

After positioning lead edge 8.1 of sheet 8 as shown in FIG. 3A, control circuit 60 operates the motor to lower print head 25 and press print head 25 against donor web 21 so that donor web 21 and lead edge 8.1 of sheet 8 are captured and held between print head 25 and platen 50 (see FIGS. 4A and 4B). Note how leading edge 8.1 is positioned proximate to and just short of heat line 44 where print head 25 is lowered and engaged with donor web 21. Next, control circuit 60 lowers print head 25, energizes the printing elements heat line 44, and actuates stepper motor 51. In response, platen 50 frictionally drives both sheet 8 and donor web 21 past heat line 44. In a manner well-known in the art, the thermal elements in heat line 44 are selectively operated to transfer donor material, for example, thermal-dye transfer material from donor web 21 to sheet 8.

Figure 5:
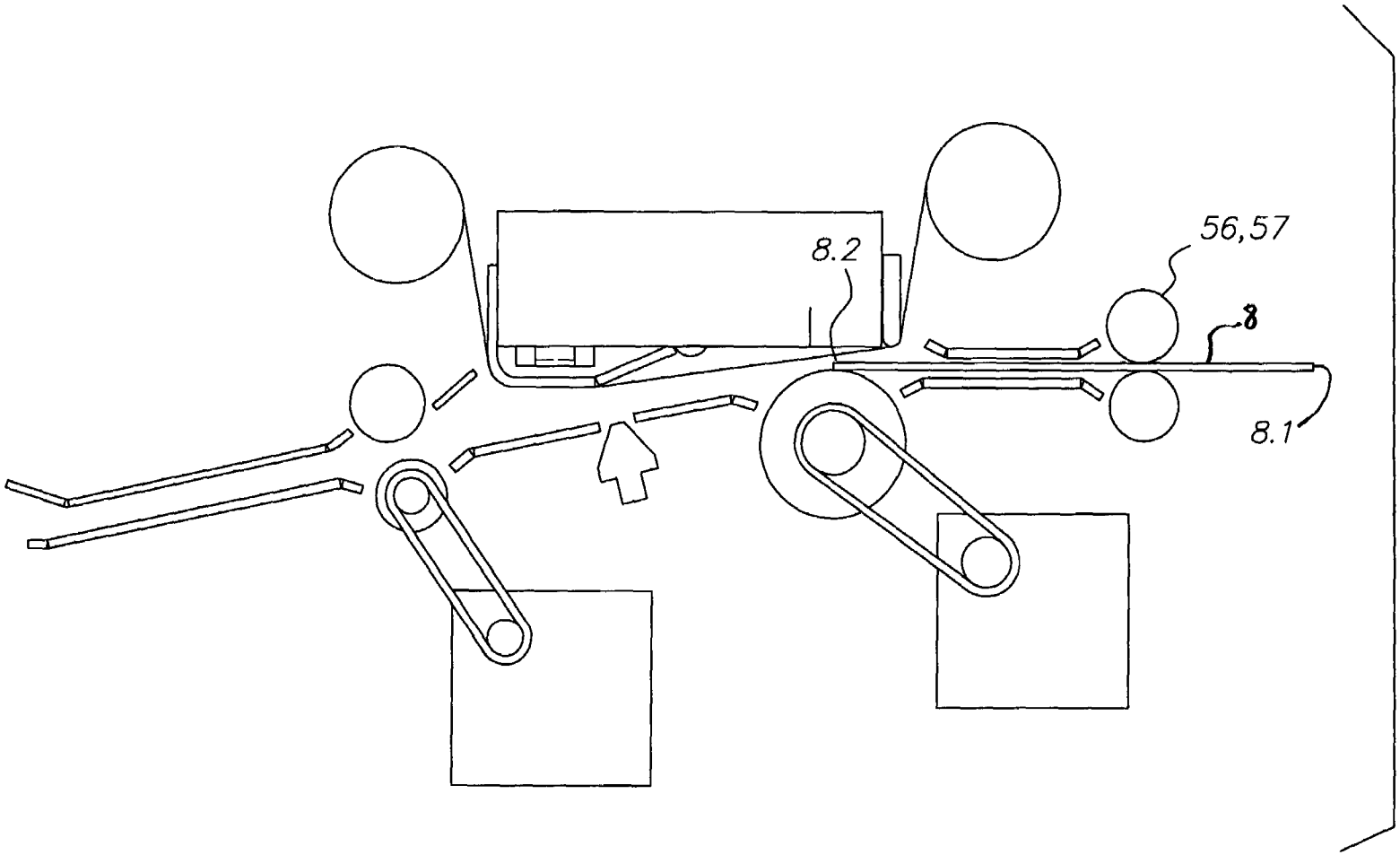
FIG. 5 shows the last step of the process where the sheet is ejected from the apparatus.
Figure 6:
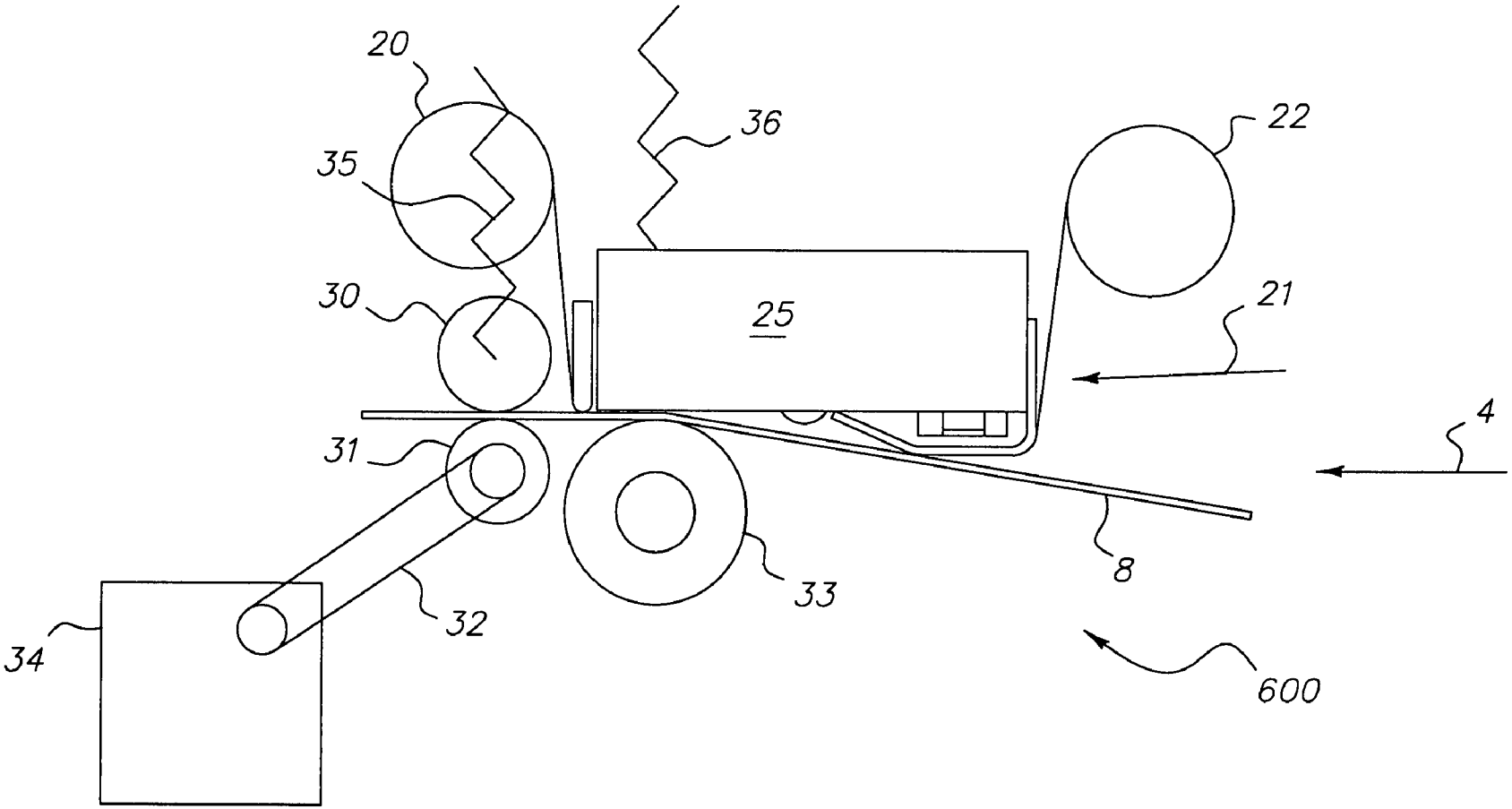
(PRIOR ART) FIG. 6
FIG. 6 shows a mechanical schematic view of a prior art printer.

After a color or clear laminate is transferred to sheet 8, control circuit 60 stops sheet 8 in the position shown in FIG. 5. There, trailing edge 8.2 of sheet 8 is just past heat line 44. Control circuit 60 turns off heat line 44 and raises print head 25 to release sheet 8 from the nip of print head 25 and platen 50. Next, control circuit 60 turns on exit urge rollers 56, 57 to drive sheet 8 in the reverse direction past edge sensor 40. When edge sensor 40 senses leading edge 8.1 of the returning sheet, exit urge rollers 56, 57 are stopped.

Donor web 21 can have multiple, sequential sections of different colors or a clear laminate and the single printing cycle described above is repeated for each color and for the clear laminate. A typical color print operation includes serial printing from section of yellow, magenta, cyan dyes and then transferring a clear, protective layer on sheet 8. After each color or clear section is printed, sheet 8 is returned to its initial position for printing the next color from the donor web. FIG. 5 also shows the end of the process where, after one or more successive transits across print head 25, sheet 8 is discharged from printer 10. Exit urge rollers 56, 57 are actuated to drive the sheet to the right as seen in FIG. 5 and thereby discharge sheet 8 with a printed image from the printer 10.

The invention achieves borderless printing on a single sheet by precisely locating the leading edge of the sheet of paper. Edge sensor 40 senses the leading edge 8.1 of a sheet 8. Stepper motors precisely drive sets of exit urge rollers 15, 16 and platen 50 to precisely position the paper at its initial position for each printing cycle. Exit urge rollers 56, 57 may be driven by ordinary motors because it is not necessary to precisely control the passage of sheet 8 between those rollers. In this way, thermal-dye transfer material may be transferred from leading edge 8.1 of sheet 8 to trailing edge 8.2 of sheet 8, thereby eliminating any border on the leading and trailing edges.

The invention has been described in detail with particular reference to certain preferred embodiments thereof, but it will be understood that variations and modifications can be effected within the spirit and scope of the invention.

PARTS LIST

3. arrow
4. print path
8. sheet
8.1. leading edge
8.2 trailing edge
10. printer
11. pick roller
12. hopper
13. paper guide
14. paper guide
15. upper urge roller
16. driver urge roller
17. stepper motor
18. transmission
19. print head guide
20. supply roller
21. web
22. supply roller
23. take-up reel
24. peel plate
25. print head
30. pinch roller
31. capstan roller
32. belt
33. platen
34. motor
35. spring
36. spring
37. platen
38. belt
39. motor
40. edge sensor
44. linear array of heat elements (heat line or print line)
45 initial position
50. platen
51. stepper motor
52. belt
53. guide
54. guide
56. exit urge roller
57. exit urge roller
60. control circuit
600. prior art thermal dye transfer printer

The invention claimed is:

1. A printer for borderless platen driven printing comprising:

a print head comprising a linear array of printing elements defining a print line and moveable toward or away from a donor web to clamp a receiver sheet between the donor web and a platen, said print head selectively operable to transfer donor material from the donor web to the receiver sheet;

a donor web between the print head and one side of the receiver sheet;

a platen for engaging the other side of the receiver sheet and for moving the receiver sheet past the print head;

a sensor for detecting a lead edge of the receiver sheet;

a first pair of urge rollers disposed on one side of the platen and engaged with each other to controllably define a nip for capturing the receiver sheet, the first pair of urge rollers being operable in response to the sensor for moving the receiver sheet to an initial position at which the platen can begin to move the receiver sheet;

a second pair of urge rollers disposed on the other side of the platen and engaged with each other to controllably define a nip for capturing the receiver sheet and operable to rotate in a first direction to return the receiver sheet past the printhead to the first pair of urge rollers; and a controller adapted to cause the first pair of urge rollers to define a nip to capture the receiver sheet and advance a lead edge of the receiver sheet, to determine when the sensor detects the lead edge of the receiver sheet, to use the first pair of urge rollers to advance the receiver medium to a position where the print head can clamp the lead edge in a nip between the print head and the platen, said controller causing the print head to clamp the receiver sheet between the donor web and a platen and said first pair of urge rollers to release the receiver sheet; said controller then causing the platen to advance the receiver sheet while causing the printhead to transfer donor material to the receiver sheet to form an image, with said controller further being adapted to cause the second pair of urge rollers to define a nip for capturing the printed receiver sheet and to cause the printhead to release the clamping;

wherein said controller causes the second pair of urge rollers to return the receiver medium past the printhead to the first pair of urge rollers and to subsequently cause the first pair of urge rollers to define a nip to capture the receiver sheet and then causes the second pair of urge rollers to define a nip to release the receiver sheet.

2. The printer of claim 1, wherein the first pair of urge rollers are operable to rotate in either direction to advance or retract the receiver sheet.

3. The printer of claim 1, wherein one roller of the first pair of urge rollers is driven by a stepper motor for precisely positioning the receiver sheet.

4. The printer of claim 1, wherein one roller of the second pair of urge rollers is driven by a stepper motor for precisely positioning the receiver sheet.

5. The printer of claim 1, wherein the first pair of urge rollers, platen and the second pair of urge rollers are arranged along a non-recirculating path.

6. The printer of claim 1, wherein the platen advances the receiver medium along a path of movement that is unsupported after the receiver sheet is advanced past the nip between the print head and the platen.

* * * * *